US005525032A

United States Patent [19]

Kreis et al.

[11] Patent Number: 5,525,032

[45] Date of Patent: Jun. 11, 1996

[54] PROCESS FOR THE OPERATION OF A FLUID FLOW ENGINE

[75] Inventors: Erhard Kreis, Otelfingen; Pierre Meylan, Neuenhof, both of Switzerland

[73] Assignee: ABB Management AG, Baden, Switzerland

[21] Appl. No.: 409,030

[22] Filed: Mar. 23, 1995

[30] Foreign Application Priority Data

Apr. 2, 1994 [DE] Germany ..... 44 11 616.0

[51] Int. Cl.[6] ..... F01D 5/08

[52] U.S. Cl. ..... 415/1; 415/115; 415/175

[58] Field of Search ..... 415/1, 47, 115, 415/116, 175, 177, 180

[56] References Cited

U.S. PATENT DOCUMENTS

| | | | |
|---|---|---|---|
| 2,656,147 | 10/1953 | Brownhill et al. | 416/97 R |
| 4,117,669 | 10/1978 | Heller | 415/116 |
| 4,257,222 | 3/1981 | Schwarz | 415/175 |
| 4,576,547 | 3/1986 | Weiner et al. | 415/175 |
| 4,795,307 | 1/1989 | Liebl | 415/115 |
| 4,893,983 | 1/1990 | McGreehan | 415/116 |
| 4,967,552 | 11/1990 | Kumata et al. | 415/115 |

FOREIGN PATENT DOCUMENTS

| | | |
|---|---|---|
| 0235641 | 2/1987 | European Pat. Off. . |
| 3909577 | 10/1989 | Germany . |

*Primary Examiner*—Edward K. Look
*Assistant Examiner*—James A. Larson
*Attorney, Agent, or Firm*—Burns, Doane, Swecker & Mathis

[57] ABSTRACT

In a process for operating a fluid flow engine, a conditioning medium is conducted through the rotor, which consists of several shaft parts (1, 2) welded together; this medium is capable of evening out the temperature difference established between the stator (3) and the rotor in the transient operating ranges, depending on whether heating or cooling of the rotor is suited to the characteristic curve of the stator temperature course.

5 Claims, 2 Drawing Sheets

PROCESS FOR THE OPERATION OF A FLUID FLOW ENGINE

FIELD OF THE INVENTION

The present invention relates to a process for operating a fluid flow engine to equalize the temperature differences between the stator and the rotor.

BACKGROUND OF THE INVENTION

As a rule, for manufacturing reasons, the inside of shafts, particularly of large turbomachines—for example with welded rotors—includes large, rotationally symmetrical cavities which are filled with the inert gas used in welding, typically argon. Cavities of this kind act as heat insulation in transient operating ranges, that is upon startup and shutdown of the turbomachine. Furthermore, it happens that welded turbomachine shafts of this kind, because of their configuration with a small surface area for heat exchange and because of the unheated disk construction, are very sluggish from a thermal standpoint. The growing demand for less play in the blading comes up against limiting factors, especially in welded shafts of this kind, because when the turbomachine is shut down, for example, the stator cools down faster than the shaft, and as a result the minimizing of the play in the blading is illusory during this process because here, the play in the blading must be always maximized if one wishes to prevent a locking of the rotating parts between stator and shaft, which could then easily even lead to a slip-joint between these parts, and therefore to a breakdown of the machine. When the turbomachine is started, it behaves in the opposite manner: The stator expands faster than the shaft, and as a result, while no locking of the rotating parts occurs until the temperature in the system is equalized or adapted, nevertheless major losses at the gaps, which reduce efficiency, occur.

OBJECT AND SUMMARY OF THE INVENTION

The invention seeks to overcome these problems. The object of the invention defined by the claims is to propose provisions, in a process of the type mentioned at the beginning, that effect an elimination of the gap losses and that make it possible to minimize the gap play between rotor and stator without having to take into account the temperature expansions in the transient operating ranges of the system.

Because when the rotor is of the welded type the stator cools faster than the shaft, i.e. this shaft behaves more sluggishly than the stator, thermally speaking, these provisions are meant to act upon the shaft. One must distinguish whether the shaft must be heated or cooled compared to the stator in the respective operating state. In accordance with this distinction, the shaft is conditioned by means of a system of internal conduits with a hot or a cool medium. Normally this is a hot gas on the one hand and cooling air on the other. A conditioning with liquid media is also quite possible.

An advantage of the invention is thus considered to be that the shaft can be adapted to the temperature course of the stator. Particularly when the turbogroup is shut down, it is unnecessary to plan for the long running times which were customary before to level out the temperature between stator and shaft, which are very detrimental to the actual availability of the system.

A further advantage of the invention is considered to be that the play in the blading can now be promptly minimized, which has a positive effect on the efficiency of the system.

It must further be emphasized, as mentioned shortly before this, that it is now possible without any additional effort to also turn off the turbogroup for a short time, and then to bring it back into the operational state again just as quickly.

Advantageous and appropriate improvements of the attainment of the object according to the invention are characterized in the further dependent claims.

Exemplary embodiments of the invention taken from the drawings are explained in more detail below. All elements which are not required for the immediate understanding of the invention have been left out. The same parts have the same reference numerals in the different drawing figures. The flow direction of the media is indicated with arrows.

DETAILED DESCRIPTION

Figure 1:
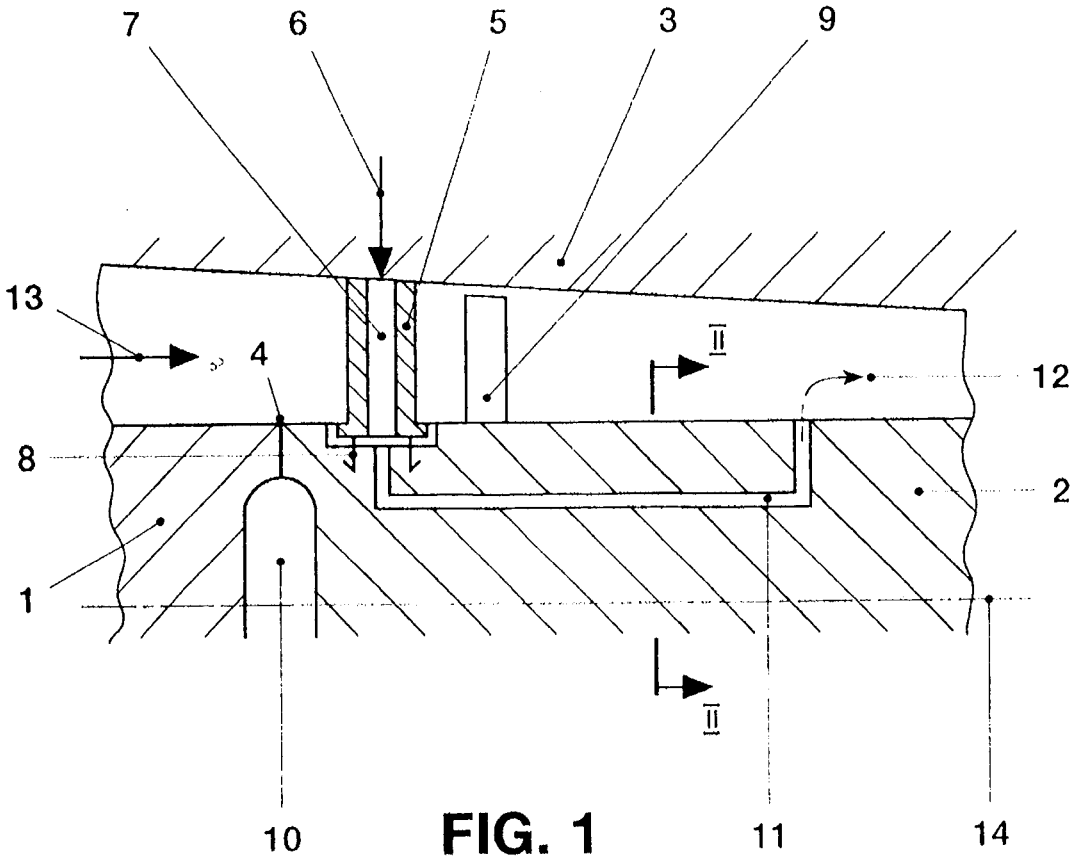
FIG. 1 shows a detail of a fluid flow engine, whose shaft is provided with axial flow conduits.

The fluid flow engine indicated here as a compressor according to FIG. 1 is comprised of a stator 3 and a rotor. The rotor, i.e. the shaft, in this FIG. consists of two shaft parts 1, 2, which are connected to each other by means of welds. The weld 4 extends circumferentially only over a fraction of the face end for weld engineering reasons. The shaft ends of the shaft parts 1, 2 have rotationally symmetrical recesses, which after welding form a rotationally symmetrical cavity 10. On the flow side and downstream of the cavity 10, in the circumferential direction, a ring of stationary blades 5 are disposed between stator 3 and shaft 1, 2, which channel the flow of working gas 13 to the turbine blades 9 that follow. The stationary blades 5 are each provided with a cover plate, which is let into the shaft. Furthermore, the stationary blades 5 are provided with a continuous conduit 7 that is continued in the shaft part 2; a labyrinth seal 8 is provided at this transition. This continuation conduit 11 extends in the axial direction and extends a predominant portion of the entire length of the corresponding shaft part 2 of the fluid flow engine. At the very least it extends into the region of the cavity that follows, which is not shown. In the radial direction, the continuation conduit 11 is attached roughly in the middle of the radius of the respective shaft part 2, as measured from the axis 14. In principle, the radial partitioning must be carried out so that the entire shaft is subjected to an even temperature influence. Thus it can be postulated that the axial course of the continuation conduits 11 must be provided closer to the hotter surface of the shaft. Depending on the temperature conditioning of the shaft parts 1, 2 in comparison to the stator 3, a conditioning medium, preferably a conditioning gas 6, flows at an appropriate temperature via the conduit 7 of the stationary blade 5 into the continuation conduit 11. After flowing axially through it, this gas 12, which is employed to promote cooling or heating, is discharged at suitable positions into the flow of the working gas 13 of the corresponding fluid flow engine. In principle, the described temperature conditioning of the shaft in comparison to the stator in the different operational states is also good to a greater degree for the shaft parts in the region of the turbine. If one is using a single-shaft machine, particular attention must be paid to the temperature conditioning in the region of the shaft part on the turbine end compared to the colder shaft part on the compressor end. In this temperature conditioning of the individual shaft parts, it should moreover be taken into account that with a welded shaft, the radiation-dictated heat transfer in the cavity 10 makes up about 5% of the metallic thermal efficiency. For the most part, the temperature conditioning of the shaft must be designed for cooling, with the aim of more rapidly achieving the cooling of the shaft, for the reasons mentioned.

Figure 2:
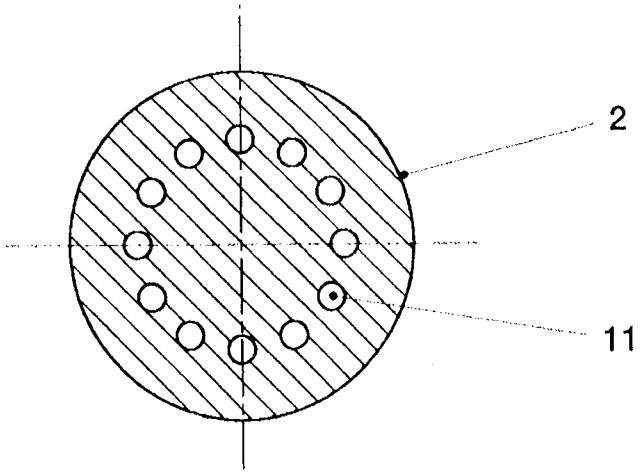
FIG. 2 shows a cross section of the shaft along the intersecting plane II—II.

FIG. 2 shows a section through the shaft part 2. In it, the continuation conduits 11 are shown, which being spaced apart from each other make possible uniform temperature conditioning of the shaft. It must be taken into account that the spacing of the continuation conduits 11 from one another, because of the different force influences upon the shaft, may not be chosen as overly small, in order to not weaken this shaft; in other words, under some circumstances, not every stationary blade 5 has a conduit 6, and this also depends upon which media circuit or loop the continuation conduits 11 are disposed in. For manufacturing engineering reasons, the course of the individual continuation conduits 11 is laid out individually; for example in sintered shaft parts, a system of communicating conduits having a reduction of the inlet and outlet openings for the gas employed can easily be used. See FIG. 3 for this aspect.

Figure 3:
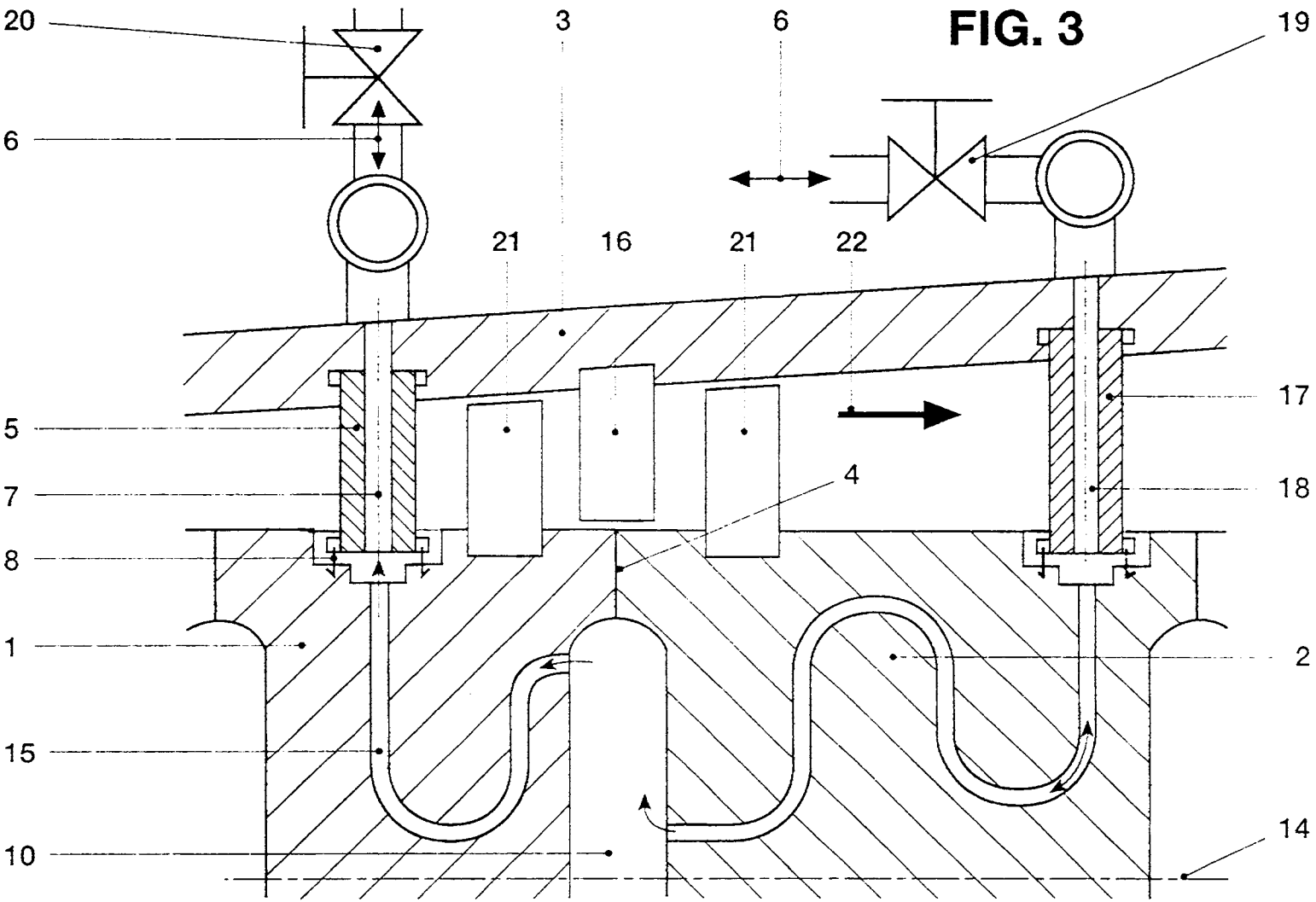
FIG. 3 shows a further detail of a fluid flow engine, whose shaft is provided with an undulating conduit course.

FIG. 3 shows a further fluid flow engine or machine, which is represented as a turbine. The problems involved in adapting or equalizing the characteristic curve of the temperature course between stator and rotor, however, are the same. Compared to FIG. 1, FIG. 3 shows that the supply of the conditioning gas 6 in comparison to the hot gas 22 can be disposed in both directions. To this end, on the end of the shaft part 2, a stationary blade configuration 17 is also provided which is likewise provided with a through flow conduit 18. This kind of operating mode calls for a controllable valve 19, 20 for each of the two through flow conduits 7, 18. For easier comprehension, the turbine is shown with two turbine blades 21 and a single stationary flow blade 16 connected between them. In comparison to FIG. 1, the continuation conduits 15 in the shaft parts 1, 2 are no longer laid out strictly axially, rather they describe an undulating course, which has the advantage of more integrally engaging the entire material thickness of the shaft. These continuation conduits 15 feed into the cavity 10 and flow onward from there, and as a result they are thermally influenced there as well.

What is claimed is:

1. A process for operating a fluid flow engine, the fluid flow engine comprising a stator and a rotor, the rotor comprising a shaft formed of several shaft parts welded together, and wherein the individual shaft parts have a rotationally symmetrical recess on their ends, the process comprising the step of circulating a conditioning medium through conduits disposed in the rotor shaft and the recesses in a closed circuit, wherein a temperature difference established between the stator and the rotor in transient operating ranges is equalized so that the rotor is thermally influenced according to a characteristic curve of a stator temperature course.

2. The process according to claim 1, wherein the conditioning medium is directed after flowing through the conduits disposed inside the rotor to flow outside the rotor.

3. The process according to claim 2, wherein a temperature increase of the rotor is carried out by providing a quantity of hot gases as the conditioning medium.

4. The process according to claim 2, wherein a cooling of the rotor is carried out by providing a quantity of cooling air as the conditioning medium.

5. The process as claimed in claim 1, comprising the step of introducing the conditioning medium into the rotor shaft through at least one conduit located inside a stationary blade of the stator.

* * * * *